United States Patent [19]

Woodruff

[11] 4,149,830

[45] Apr. 17, 1979

[54] VARIABLE DISPLACEMENT PISTON PUMP

[75] Inventor: Frank Woodruff, New Hartford, N.Y.

[73] Assignee: The Bendix Corporation, Teterboro, N.J.

[21] Appl. No.: 796,933

[22] Filed: May 16, 1977

[51] Int. Cl.[2] ..... F04B 1/26

[52] U.S. Cl. ..... 417/222; 60/452; 74/60

[58] Field of Search ..... 417/218, 222, 270; 60/445, 452; 74/60; 91/506

[56] References Cited

U.S. PATENT DOCUMENTS

| | | | |
|---|---|---|---|
| 2,129,828 | 9/1938 | Dunn | 417/222 |
| 2,711,135 | 6/1955 | Dunlap | 417/222 |
| 2,955,475 | 10/1960 | Zubaty | 417/222 X |
| 3,512,178 | 5/1970 | Russell | 417/218 X |
| 3,575,534 | 4/1971 | Leduc | 417/218 |
| 3,637,327 | 1/1972 | Kubiak | 417/222 |
| 3,784,328 | 1/1974 | Pederson | 417/222 |
| 3,806,280 | 4/1974 | Bobier | 417/222 |
| 3,873,240 | 3/1975 | Leduc et al. | 417/222 |

FOREIGN PATENT DOCUMENTS

| | | | |
|---|---|---|---|
| 2212895 | 9/1973 | Fed. Rep. of Germany | 417/269 |
| 39-32901 | 4/1964 | Japan | 417/222 |
| 865876 | 4/1961 | United Kingdom | 417/222 |

*Primary Examiner*—Carlton R. Croyle
*Assistant Examiner*—Edward Look
*Attorney, Agent, or Firm*—Anthony F. Cuoco

[57] ABSTRACT

A variable displacement pump includes a plurality of pistons and a swash plate arranged therewith, with the swash plate displaced in response to pump discharge manifold pressure for controlling the stroke of the pistons to maintain a predetermined substantially constant pressure with a variable flow of fluid through the pump.

6 Claims, 2 Drawing Figures

VARIABLE DISPLACEMENT PISTON PUMP

BACKGROUND OF THE INVENTION

1. Field of the Invention

This invention relates generally to variable displacement piston pumps and, particularly, to pumps of the type described which are compensated for maintaining constant pressure with variable flow. More particularly, this invention relates to means for controlling the stroke of the pump pistons to provide the aforenoted compensation.

2. Description of the Prior Art

The pump disclosed is particularly intended for use in electronic actuator diesel fuel injection systems. For this application and for other applications, a minimal pressure ripple or variation with a variation in fluid flow is desirable. Check valve type pumps, which are well known in the art, fulfill this requirement by including check valves for controlling pump discharge and/or inlet functions, and further include an arrangement for varying the stroke of the pump pistons. In pumps of this type, the pressure in the piston cylinders must be slightly greater than the pressure in the discharge manifold before the check valve opens. This is contrary to rotating cylinder block type pumps wherein communication is established between the cylinders and the discharge manifold at some predetermined pump shaft angle, without regard to the respective pressures. The novel feature of the present invention is the arrangement effected by pump discharge manifold pressure and used for varying the stroke of the pump pistons.

SUMMARY OF THE INVENTION

This invention contemplates a variable displacement piston pump including a shaft having a driven end and an opposite end arranged for supporting a swash plate to pivot about an axis displaced from and normal to the center line of the shaft. A plurality of pistons having hollow cylinders extending therethrough are arranged with corresponding check valves in a pump block. During the "delivery" stroke of the pistons the pressure in the cylinders becomes sufficient to actuate the check valves, whereby fluid is delivered to a common discharge manifold. When the manifold pressure approaches a predetermined value, a force is created which is transmitted to the swash plate and pivots the plate away from a maximum flow position. The pistons are arranged with the swash plate so that when the swash plate pivots, the stroke of the pistons is decreased to reduce fluid flow and pressure. Equilibrium is thus established and a reduced fluid flow at a predetermined substantially constant pressure is maintained.

One object of this invention is to provide a variable displacement piston pump having the capability of maintaining a predetermined substantially constant pressure with a variable flow of fluid through the pump.

Another object of this invention is to provide a swash plate arranged with the pump pistons so that when the pump discharge manifold pressure approaches a predetermined value, the swash plate is displaced away from a maximum flow position, whereupon the stroke of the pistons is decreased to reduce fluid flow and pressure and to establish an equilibrium state whereby the reduced fluid flow is maintained at a predetermined substantially constant pressure.

Another object of this invention is to provide a pump of the type described which contains fewer parts than prior art pumps for similar purposes, and which is inexpensive to manufacture and of rugged design.

The foregoing and other objects and advantages of the invention will appear more fully hereinafter from a consideration of the detailed description which follows, taken together with the accompanying drawings wherein one embodiment of the invention is illustrated by way of example. It is to be expressly understood, however, that the drawings are for illustration purposes only and are not to be construed as defining the limits of the invention.

DESCRIPTION OF THE INVENTION

Figure 1:
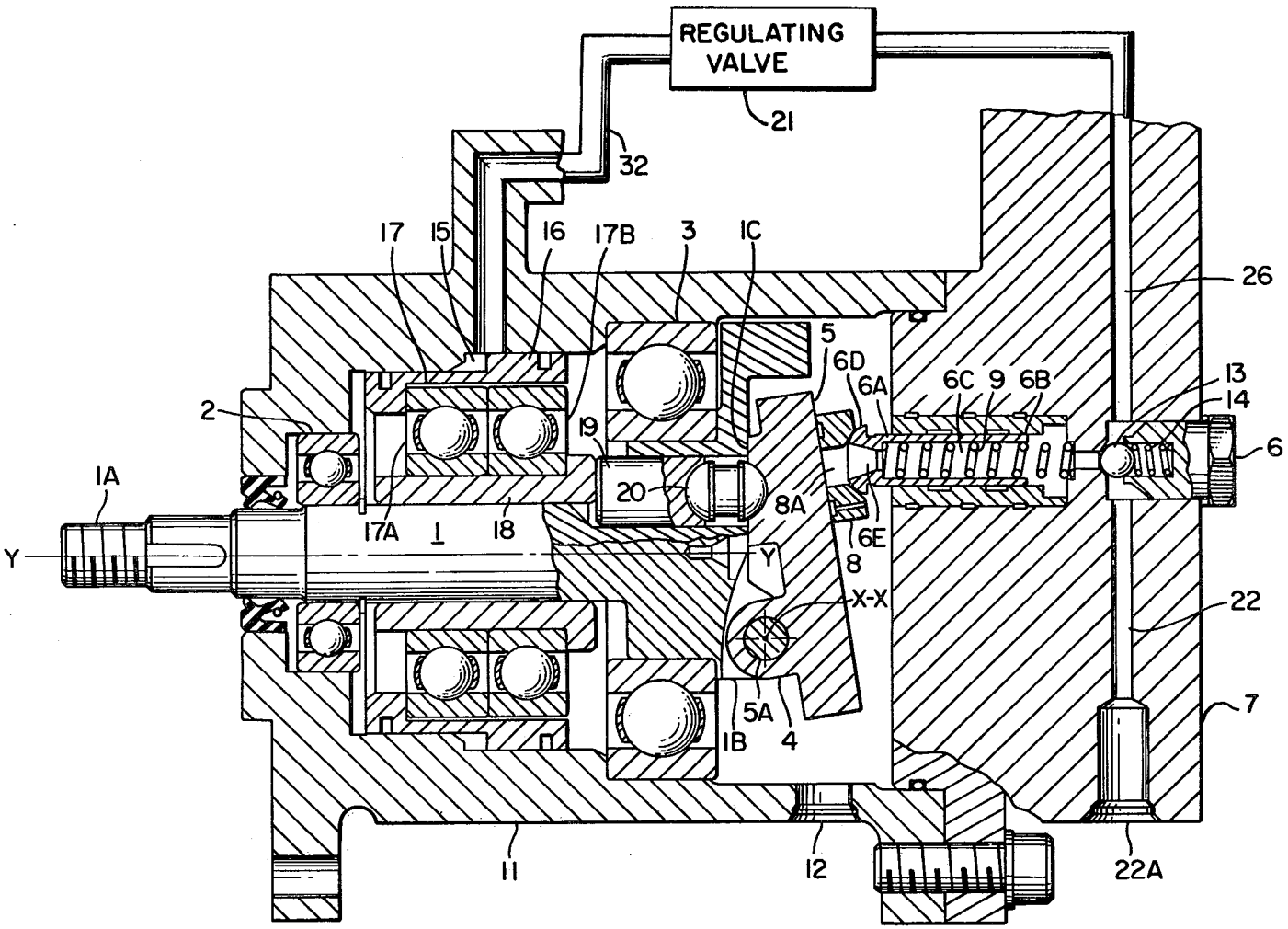
FIG. 1 is a sectioned front plan view of a pump according to the invention.

With reference first to FIG. 1, there is shown a shaft designated by the numeral 1, and which shaft 1 is journalled in bearings 2 and 3 suitably mounted in a casing 11. An end 1A of shaft 1 is arranged to be suitably coupled to an engine or other external driving means (not shown) so as to be driven thereby, while the opposite end 1B of the shaft forms a trunnion mounting 4.

A swash plate 5 is pivotally supported on trunnion mounting 4 by a pivot pin 5A so as to pivot about a trunnion mounting axis X—X. It will be noted that trunnion mounting axis X—X is displaced from and normal to the center line Y—Y of shaft 1. Swash plate 5 is limited in its counterclockwise pivoting by a shoulder 1C carried by end 1B of shaft 1.

The pump of the invention includes a plurality of piston assemblies 6, arranged in a cylinder block 7. The invention will be described in relation to one of the piston assemblies 6 as shown in FIG. 1, with the same description applying to the other piston assemblies as well.

Thus, with further reference to FIG. 1, piston assembly 6 includes a piston 6A slideably supported in a bore 6B in block 7, and including a hollow cylinder 6C. A shoe 8 is disposed intermediate a spherical end 6D of piston 6A and swash plate 5. In this connection it is noted that there is a corresponding shoe 8 for each piston assembly 6, with swash plate 5 being common to all of the piston assemblies.

It will be understood by those skilled in the art that the bearing unit loading of the shoe/piston and shoe/swash plate arrangements as shown is limited by "pressure balancing". Piston assembly 6 includes a return spring 9 disposed within piston cylinder 6C which serves to extend piston 6A on the "intake" stroke and to trap shoe 8 between piston end 6D and swash plate 5 when the pressure in piston cylinder 6C is absent or inadequate as will hereinafter become evident.

Figure 2:
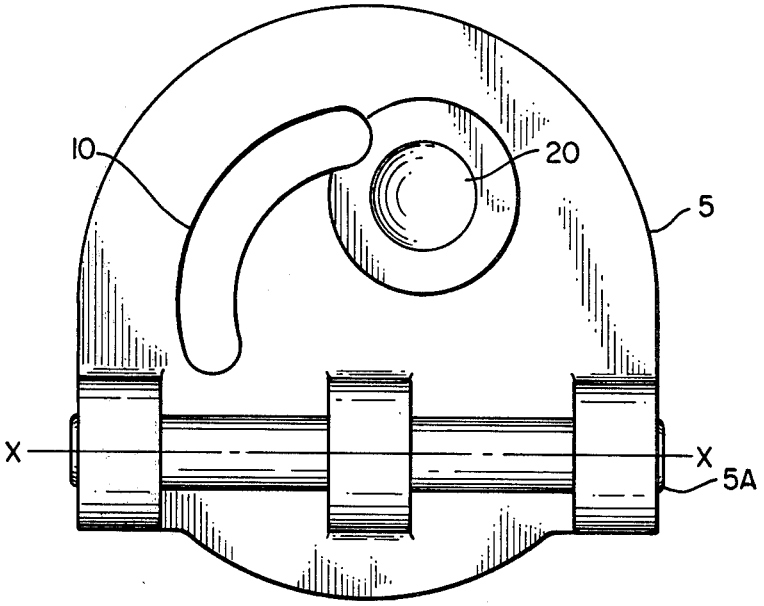
FIG. 2 is a right end view, relative to FIG. 1, of a swash plate according to the invention.

Upon rotation of shaft 1, during the "intake" stroke, fluid flows into the expanding piston cylinder volume through a port 10 in swash plate 5 best shown in FIG. 2. Pump casing 11 is internally flooded through fluid entering an inlet port 12 and, thereupon passing through an aperture 8A in shoe 8 in communication with port 10 and an aperture 6E in piston end 6D in communication with aperture 8A and in communication with piston cylinder 6C. Piston cylinder 6C is arranged with a check valve ball 13 included in piston assembly 6. In this connection it is noted that although a ball type check valve is shown other type check valves may be used as well, as will now be understood by those skilled in the art.

When piston 6A has passed top dead center, aperture 8A in shoe 8 no longer communicates with swash plate port 10, and hence piston cylinder 6C is closed and passage of fluid therethrough is blocked. Piston 6A starts its "delivery" stroke, and when the pressure in piston cylinder 6C is sufficient to displace check valve ball 13, lightly loaded by a spring 14, from its seat, fluid is delivered through the piston cylinder to a common discharge manifold 22 including a discharge port 22A and to a conduit or the like 26 which may communicate with a servo valve or the like. With continued reference to FIG. 1, the attitude of swash plate 5 shown therein is indicative of a maximum piston stroke and pump displacement.

The function of a regulating valve 21 shown in FIG. 1 is to sense discharge manifold pressure through conduit 26 and to modulate the pressure in a chamber 15 (FIG. 1) through and a conduit 32. Chamber 15 is formed by a differential area piston 16 slidingly arranged within pump casing 11.

When discharge manifold pressure approaches a predetermined and substantially desired value, valve 21 permits the pressure in chamber 15 to increase. This increase in pressure exerts a force which urges piston 16 rightward in relation to the arrangement shown in FIG. 1. This force is transmitted through a thrust bearing assembly 17 including a pair of tandem bearings 17A and 17B, a sleeve 18 supporting the thrust bearing assembly, a push rod 19 adjacent the sleeve and a rocker 20 arranged with push rod 19 and swash plate 5. When the force is high enough, it is effective through the aforenoted push rod and rocker arrangement for tilting swash plate 5 from the attitude shown in FIG. 1 to a more nearly vertical attitude. This decreases the stroke of piston 6A to reduce fluid flow and, consequently, to reduce the pressure. Equilibrium is thus established and a reduced flow at a pressure near a predetermined substantially constant pressure is maintained.

It will be noted that the thrust forces acting on pump shaft 1 are shared by bearing 3 and thrust bearing assembly 17. Bearing 3 takes the axial thrust on shaft 1 itself, but some of this thrust is relieved by bearing assembly 17.

It will also be noted that swash plate 5 is shown in a pivotable arrangement to control the stroke of pistons 6A. Any other hinge type joint would serve the purpose of the invention as well. Further, the invention is disclosed and described with reference to the displacement of swash plate 5 in one direction (clockwise) to decrease the stroke of piston 6A, with displacement occurring in the opposite direction as well as to increase the piston stroke, dependent upon manifold pressure, as will now be understood by those skilled in the art.

It will be seen from the foregoing description of the invention with reference to the drawings, that a variable displacement piston pump has been disclosed which is capable of maintaining a predetermined substantially constant pressure with a varying fluid flow. The stroke of the pistons is controlled by the novel arrangement including swash plate 5 being responsive to pump discharge manifold pressure to provide the aforenoted constant pressure with variable fluid flow.

Although but a single embodiment of the invention has been illustrated and described in detail, it is to be expressly understood that the invention is not limited thereto. Various changes may also be made in the design and arrangement of the parts without departing from the spirit and scope of the invention as the same will now be understood by those skilled in the art.

What is claimed is:

1. A variable displacement piston type pump, comprising:

a casing containing a fluid;

a shaft journalled in the casing, one end of the shaft arranged for being rotatably driven to operate the pump;

a swash plate displaceably supported within the casing by the other end of the shaft for displacement about a pivot axis displaced from and substantially normal to the shaft axis;

at least one piston having a hollow cylinder extending therethrough, and arranged with the swash plate so that the piston stroke varies with the swash plate displacement;

means arranged with the casing and the piston cylinder so that fluid flows from the casing to the cylinder during the pump intake stroke and is blocked from flowing during the pump delivery stroke;

a pump discharge manifold;

check valve means arranged with the manifold and the piston cylinder and actuated by a predetermined fluid pressure in the piston cylinder during the delivery stroke for permitting passage of fluid from the cylinder to the manifold, whereupon a pressure is created in the manifold;

means responsive to a predetermined manifold pressure for displacing the swash plate and varying the piston stroke to provide a variable flow of fluid through the pump at a substantially constant pressure and including a chamber within the casing, a port extending through the casing and into the chamber, regulating valve means communicating with the manifold and the port and responsive to the predetermined manifold pressure for applying a regulated pressure through the port to the chamber, and means disposed in the casing and responsive to the regulated pressure for displacing the swash plate;

the means for displacing the swash plate including piston means slidingly arranged within the casing and cooperating therewith to form the chamber, and the regulated pressure applied through the port to the chamber exerting a thrust for displacing the piston means; and means disposed between the piston means and the swash plate for transmitting the thrust which displaces the piston means to the swash plate for displacing the swash plate, and including thrust bearing means, a sleeve supporting the thrust bearing means, a push rod disposed adjacent the sleeve and rocker means arranged with the push rod and swash plate for displacing the swash plate in response to the transmitted thrust.

2. A pump as described by claim 1, wherein:

the piston stroke varies with the swash plate displacement so that the stroke decreases when the swash plate is displaced toward a position normal to the shaft and away from the driven shaft end, and increases when the swash plate is displaced away from the normal position and toward the driven shaft end.

3. A pump as described by claim 2, wherein:

the other shaft end includes means for limiting the displacement of the shaft toward the driven end.

4. A pump as described by claim 1 including:

the other end of the shaft forming a trunnion mounting; and the swash plate pivotally supported on the trunnion mounting for displacement about the pivot axis.

5. A pump as described by claim 1, wherein the means arranged with the casing and the piston cylinder so that fluid flows from the casing to the cylinder during the pump intake stroke and is blocked from flowing during the pump delivery stroke includes:

the swash plate having a fluid inlet port through which fluid flows from the casing; and the piston cylinder being in communication with the swash plate inlet port during the pump intake stroke, whereupon fluid flows through the port to the cylinder, and being out of communication with the port during the pump delivery stroke, whereupon said flow of fluid is blocked.

6. A pump as described by claim 1 including:

the shaft journalled in the casing by a first bearing at the one shaft end and by a second bearing at the other shaft end; and the forces created by the transmitted thrust being shared by the thrust bearing means and the second bearing.

* * * * *